United States Patent [19]

Platt

[11] Patent Number: 4,480,766

[45] Date of Patent: Nov. 6, 1984

[54] BULK TRANSPORT BAG

[75] Inventor: Nigel D. Platt, Melton Constable, England

[73] Assignee: IBC Transport Containers, Ltd., East Molesey, England

[21] Appl. No.: 422,392

[22] Filed: Sep. 24, 1982

[51] Int. Cl.[3] ..... B65D 33/14; B65D 33/28

[52] U.S. Cl. ..... 222/105; 222/107; 222/181; 294/74; 383/17; 383/24; 383/67

[58] Field of Search ..... 222/92, 105, 107, 173, 222/180, 181, 185, 465 R, 466, 478, 481, 482, 526, 527, 529, 531, 544, 566; 383/17, 22, 24, 41, 67; 294/74; 428/290; 156/308.2, 308.4

[56] References Cited

U.S. PATENT DOCUMENTS

| | | | |
|---|---|---|---|
| 3,567,110 | 3/1971 | Susuki | 383/17 |
| 3,893,595 | 7/1975 | Khanna et al. | 222/185 |
| 3,960,192 | 6/1976 | Convain | 383/22 X |
| 3,998,304 | 12/1976 | Edgerton, Jr. et al. | 383/24 |
| 4,113,146 | 9/1978 | Williamson | 222/181 |
| 4,158,711 | 6/1979 | Gould | 156/308.2 X |
| 4,211,266 | 7/1980 | Massey | 383/22 |
| 4,216,899 | 8/1980 | Kamp | 383/17 |
| 4,300,608 | 11/1981 | Cuthbertson | 383/22 |
| 4,395,067 | 7/1983 | Robin | 294/74 |
| 4,410,575 | 10/1983 | Obayashi et al. | 156/308.2 X |

FOREIGN PATENT DOCUMENTS

| | | | |
|---|---|---|---|
| 1340693 | 12/1973 | United Kingdom | 222/105 |

*Primary Examiner*—Charles A. Marmor
*Assistant Examiner*—Lawrence J. Miller
*Attorney, Agent, or Firm*—Louis Orenbuch; John Welch

[57] ABSTRACT

A bulk transport bag comprises a bag body made of a flexible fabric coated with a plastic material such as PVC, and lifting webs defining lifting loops, which lifting webs are made of a fabric web impregnated and/or coated with a plastic material such as PVC compatible with that coated on the body fabric, the lifting webs and bag body being bonded together by a weld through the compatible plastics materials effectively to form an integral structure. Anti-peel devices are preferably provided at the upper periphery of the side wall of the bag body, where the bonded regions of the lifting webs separate from the bag body to form the lifting loops.

14 Claims, 4 Drawing Figures

BULK TRANSPORT BAG

FIELD OF THE INVENTION

This invention relates to a bulk transport bag, i.e. a bag of suitably treated flexible material especially intended for the transportation of flowable materials, i.e. materials such as pulverulent or granular or analogous materials which can be poured into and out of a bag, including liquid materials.

PRIOR ART

At the present time there exist relatively cheap, one-trip bags intended to be disposed of after one use, and expensive, multiple-trip bags capable of re-use many times. The latter bags are commonly made of plastics coated fabric, with a main materials-containing body, a top inlet chute and a bottom outlet spout. Means are incorporated in the bag to enable it to be lifted from the top, as by a fork lift truck, to facilitate filling with the top inlet open or emptying with the bottom outlet open, and to facilitate loading and unloading the bag on to or from a transporting vehicle or ship or plane or conveyor. Known lifting means comprise a steel band or collar around the top of the main body, and a yoke means which cooperates with the collar to support the bag. The yoke means may be a part of the bag assembly or be separable therefrom. In either case, the provision of the lifting means is a costly procedure in terms of labour and materials, and makes the re-usable bulk transport bag an expensive item. Multiple trip bags of the aforementioned type are known, in particular, from U.K. Patent Specifications No. 1129917 and No. 1177745.

Another type of multiple trip bag is known from U.K. Patent Specifications No. 1455874 and No. 1484984. This bag has a stitched polypropylene body with lifting loops stitched thereto, and can be provided with an inner liner of impervious plastics material formed with an outlet chute which projects through an aperture in the bottom wall of the polypropylene body. The inner liner is for single trip or very limited multiple trip use. As is clear from the same patentees' earlier U.K. Patent Specifications No. 1431581 and No. 1431582, relatively complicated and costly hemming and stitching procedures are necessary in an endeavour to impart sufficient strength to the connections between the lifting loops and the body of the bag, having regard to the fact that a bag may carry a load of 1000 kg or more. Furthermore, the stitching renders the body of the bag pervious to moisture so that, for the transport of many materials, the provision of an impervious liner is essential for this reason alone, regardless of whatever other functions the liner may be intended to perform.

Simpler bulk transport bags, allegedly for multitrip use but in practice much less durable than those referred to above, also employ lifting straps, for example stitched either directly to the wall of the bag or to a reinforcing patch secured to the wall of the bag, or being threaded through slots or channels incorporated in the body of the bag.

BRIEF SUMMARY OF THE INVENTION

It is a general object of this invention to provide a re-usable bulk transport bag which is simpler and less costly to produce than known bags. Such bag comprises a main materials-containing body with a closable inlet and outlet for the material to be carried, and lifting means attached to said body, wherein the body is made of a fabric coated with a plastics material, and the lifting means comprises a plurality of fabric webs coated and/or impregnated with a plastics material compatible with the plastics coating on the body material, said plastics treated lifting webs being bonded to the plastics coated body through said compatible plastics materials.

In the bag in accordance with the invention, the lifting means effectively forms an integral part of the bag structure, as the plastics materials of the plastics coated bag body and of the plastics treated webs effectively tend to merge into one another when the body and bag are bonded together, as by plastics welding.

In use, when the bag is vertically lifted by the lifting webs, the stresses on the connections between the lifting webs and the bag body act substantially in the planes in which the webs are bonded to the body. In these planes, the strength of the bonds can be at least as great as that of the body and web fabrics, i.e. greatly in excess of the load of material carried in the bag. For example, each bond may be able to withstand a planar shear force of 10,000 kg.

Furthermore, the body of the bag is not penetrated by stitching where the lifting means is connected. In a preferred arrangement, the body of the bag is not penetrated by any stitching or by any other fastenings, fixings or fittings other than the closable inlet and outlet, said inlet and outlet being sealed to the bag body so that the bag is thereby rendered wholly impervious to liquid when the inlet/outlet are closed. The bag can thus be used to carry materials which must be kept dry, such as hygroscopic materials. Furthermore, the bag may have suitable inlets and outlets sealed thereto to enable said bag to be used for the transportation of liquids.

Preferably, each plastics treated lifting web is bonded at both sides of an intermediate portion of the length thereof to the side wall of the main body, so that the intermediate portion forms a lifting loop at the top of the main body, the plurality of lifting loops being symmetrically disposed around the periphery of the main body. Four lifting loops at 90 dgrees angular spacings will often be convenient.

Again, each lifting web is preferably bonded along two linear regions of the bag body spaced around the side wall thereof. Such linear bonding regions may be vertical in the upright condition of the bag body. However, more desirably, in order to distribute lifting forces more evenly around the bag body, said two linear bonding regions for each web are inclined when the bag is in its upright condition. The two inclined linear bonding regions may meet at the upper periphery of the side wall of the bag.

Each lifting loop is preferably bonded to the bag body over its entire length on each side of the intermediate portion forming the lifting loop, and each end of each bonded lifting web can be covered by a bonded patch of plastics coated fabric, thereby to form an anti-peel device. In this way, risk of accidental or deliberate abuse of the bag, brought about by attempts to peel the bonded lifting web from the bag body, starting from the ends of the web, is minimised.

In this context, whereas the extremely high strength of the plastics bonds between the lifting webs and the bag body in the planes of said bonds has been referred to, the strength of the bonds when subject to a peeling force is not so great, and may be less than 100 kg. It is therefore desirable to protect the bag against damage due, for example, to a peeling force applied to one or more of the bonds when, for example due to improperly applied lifting forces, one or more of the lifting loops is pulled outwardly from the bag. Thus, in a preferred arrangement, adjacent each point where a plastics treated web separates from the body of the bag to form the lifting means, the web passes through an anti-peel device for preventing tearing of the web from the body when the lifting means is subject to an outward peeling force at an angle to the vertical. The anti-peel devices absorb the outward components of forces applied to the lifting loops, and ensure that the forces applied to the bonds are almost wholly restricted to stresses acting in the planes of said bonds.

Each said anti-peel device may comprise an eyelet in a rim of plastics material upstanding from the upper periphery of the side wall of the bag body, or it may comprise an aperture formed between an upper edge region of the side wall of the bag body and one or more strips of plastics coated fabric bonded around said upper edge region of the side wall, with non-bonded portions of said strip or strips defining said apertures.

Thus, according to a preferred aspect of the invention, the plastics treated webs constituting the lifting means are each bonded to the side wall of the bag body at an angle to the vertical, with web portions of each web crossing one another in the manner of braces to pass through a common anti-peel device at the periphery of the side wall of the bag.

As is generally conventional in a bag for bulk transportation of pulverulent, granular or like materials, the closable inlet and outlet may comprise a central inlet chute opening through a top wall of the bag body and a central outlet spout opening out of a bottom wall of the bag body, all said parts of the bag body being made of pieces of the same plastics coated fabric bonded together to define a bag of predetermined shape. The said predetermined shape may be circular, polygonal or square, for example, but in all cases the bonding of the plastics coated fabric pieces together ensures that the bag remains impervious to liquid. For the transportation of liquids, however, the outlet spout will normally be omitted or permanently sealed, and a plug or spigot sealed in position, either in the bottom wall of the bag or at the bottom of the side wall thereof, to enable liquid to be poured off.

Preferably, the bag body is coated and the lifting webs are impregnated and/or coated with the same plastics material. By way of example, the bag body may be made of nylon or polyester fabric coated with PVC and the lifting webs made of polyester fabric impregnated and/or coated with PVC.

DESCRIPTION OF EMBODIMENTS

Figure 1:
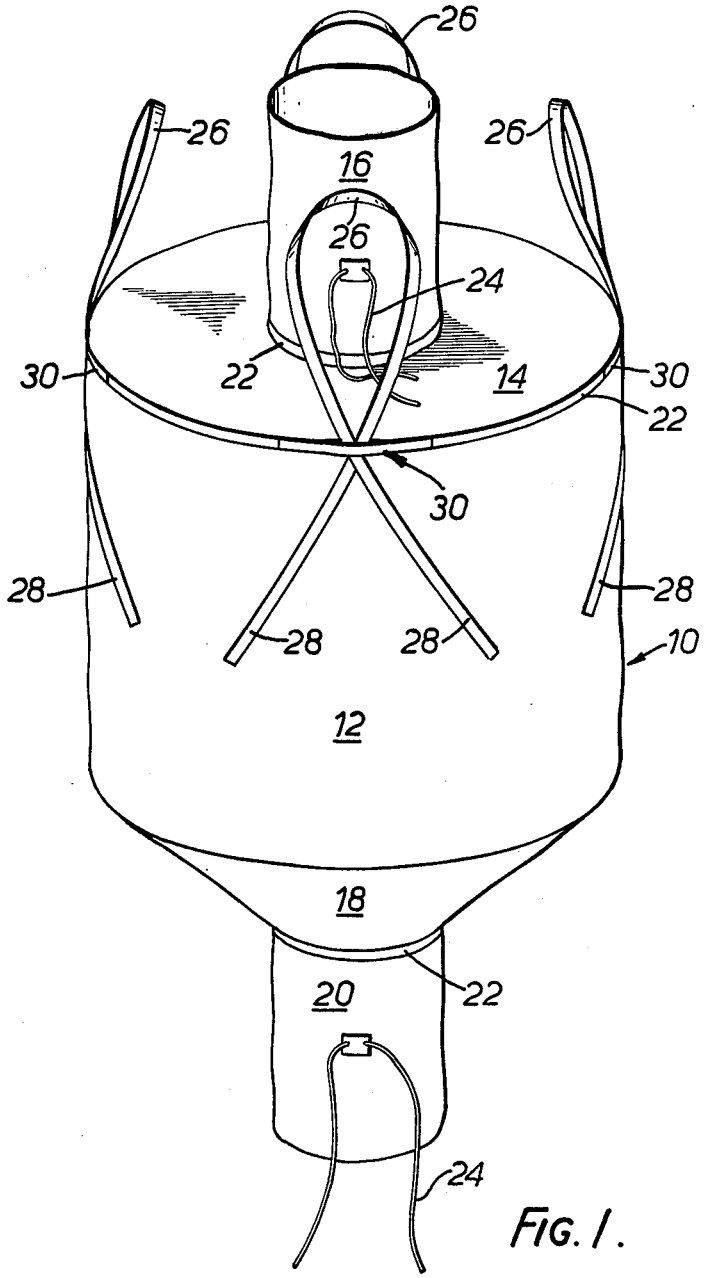
FIG. 1 is a perspective view of a bulk transport bag in accordance with the invention.

In FIG. 1, the bulk transport bag comprises a bag body, generally designated 10, made of a flexible fabric such as nylon or polyester fabric coated with a plastics material such as PVC. The bag body is generally of circular cross-section, with a side wall 12, top wall 14 to which is fitted a central inlet chute 16, and a bottom wall 18 to which is fitted a central outlet spout 20. All these parts of the bag are made of the same plastics coated fabric, and these plastics coated fabric parts are bonded together by plastics welding so as to form the bag body 10 of the predetermined shape illustrated. Welded regions are indicated by the reference 22. The bottom wall 18, which is likewise welded to the side wall 12, can be of conical form as illustrated, possibly with the angle of the cone selected to suit a particular material to be carried, or it can be flat.

Tie cords 24 are provided for closing the inlet chute 16 and outlet spout 20. However, if the bag is to be used for transportation of liquids, the outlet spout 20 may be omitted or sealed closed, and a plug or spigot sealingly fitted into the bottom wall 18, or into the bottom of the side wall 12.

In accordance with the invention, the bag body is provided with lifting loops 26. These are made of web fabric such as polyester web impregnated with a plastics material compatible with that coated on the body fabric. Thus, the lifting webs may conveniently be impregnated with the same material as that coated on the body fabric, for example PVC. Depending on the nature of the web fabric, the lifting webs may be impregnated and/or coated with this plastics material. In all instances, the lifting webs have end portions 28 bonded, each over its entire surface area on one side thereof, to the side wall 12 of the bag body 10. This bonding operation is conveniently effected by plastics welding. As a result, the compatible plastics materials of the coated body fabric and the impregnated and/or coated lifting web fabric tend to merge into one another, effectively to form the bag body and the lifting webs into an integral structure. The intermediate portion of each lifting web between its bonded end portions 28 forms a corresponding lifting loop 26, which stands up from the upper periphery of the side wall 12 of the bag body 10.

Figure 2:
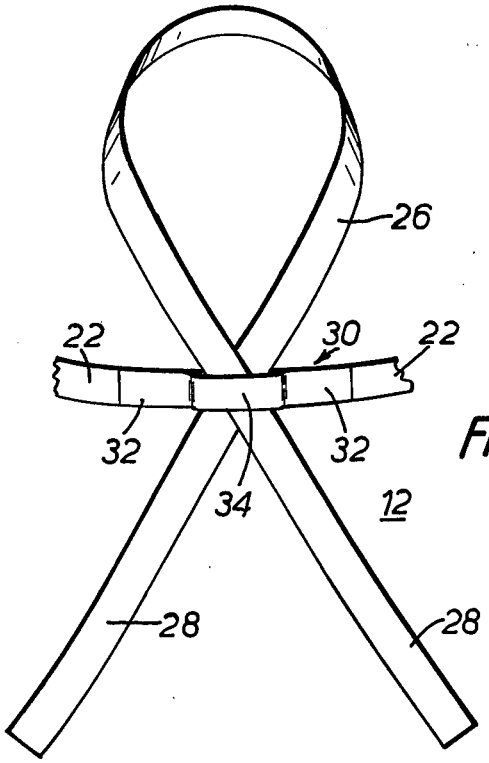
FIG. 2 shows a detail of the bag of FIG. 1.

In the embodiment illustrated in FIG. 1, and as shown in enlargement in the detail of FIG. 2, the end portions 28 of each lifting web are bonded to the bag body 10 along linear regions of the latter which are inclined to the vertical. These linear regions intersect at the upper periphery of the side wall 12 of the bag body 10, where the web crosses over itself in the manner of braces. The formation of the lifting loops 26 in this way, although not essential, has the advantage that lifting forces acting through the bonded end portions 28 of the lifting webs are spread more evenly around the fabric forming the side wall 12 of the bag body 10.

In order that peeling forces acting on the bonded lifting webs, e.g. forces which can arise if the lifting loops 26 are pulled at least partially in a radially outwards direction during lifting, are adequately resisted, anti-peel devices are provided around the upper periphery of the side wall 12 of the bag body 10 at each point where the lifting web separates from the side wall to form the lifting loop 26. In the embodiment of FIGS. 1 and 2 each such anti-peel device comprises a strip 30 of plastics coated fabric, extending around part of the upper periphery of the side wall 12. Each strip 30 is bonded at its end regions 32 to the side wall 12, and has an intermediate unbonded portion 34 which in combination with the side wall behind it defines an aperture through which the lifting web passes at the point where it crosses over itself to form the lifting loop 26. It is at this cross-over point that the bonded end portions 28 of the lifting web terminate, and the anti-peel strip 30 thus absorbs radially outward forces acting on the lifting loop and substantially prevents any peeling-off force being applied to the bonded end portions at this point. It is thereby ensured that stress forces acting on the bonds are restricted to the planes of the bonds, in which planes the bonds are more than adequately stong to resist such stresses. In a modification, the lifting loops 26 at their points of cross-over, the underlying bag wall 12 and the overlying strips 30 are all welded together as solid joints in order to form the anti-peel devices.

Figure 3:
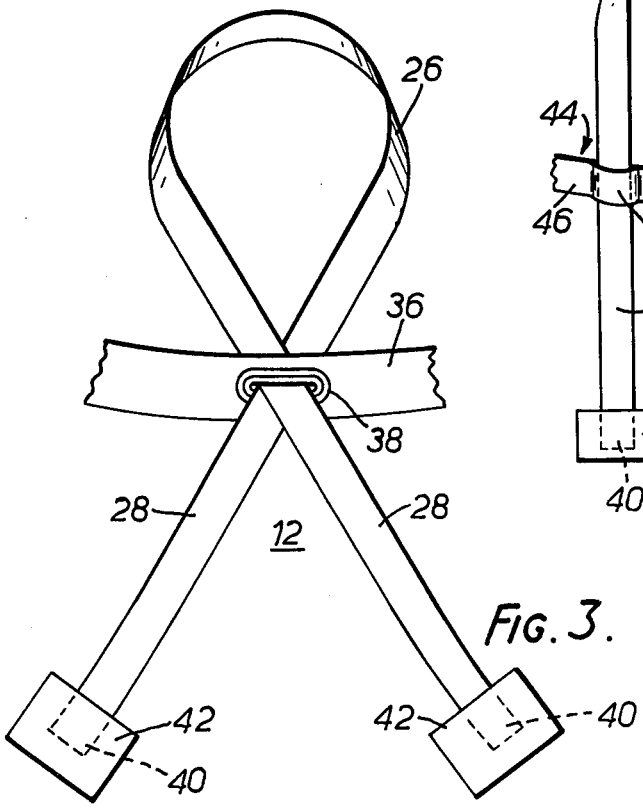
FIGS. 3 and 4 show possible modifications to the lifting means for the bag.

FIG. 3 shows another modification of the bag in which a different form of anti-peel device is employed at the upper periphery of the side wall 12 of the bag body. In this modification, the top wall of the bag body is plastics welded to the side wall to form an upstanding hem 36, and each anti-peel device comprises an eyelet device 38 incorporated in this hem. In addition, in the modification of FIG. 2, each end 40 of each lifting web, where bonded to the side wall 12 of the bag body remote from the lifting loop 26, is protected by a patch 42 of plastics coated fabric plastics welded to the side wall so as to cover such end 40 of the web. This prevents access to the ends 40 of the lifting web and thus minimises risk of accidental or deliberate abuse by application of peeling-off forces to the lifting web, starting from these ends.

Figure 4:
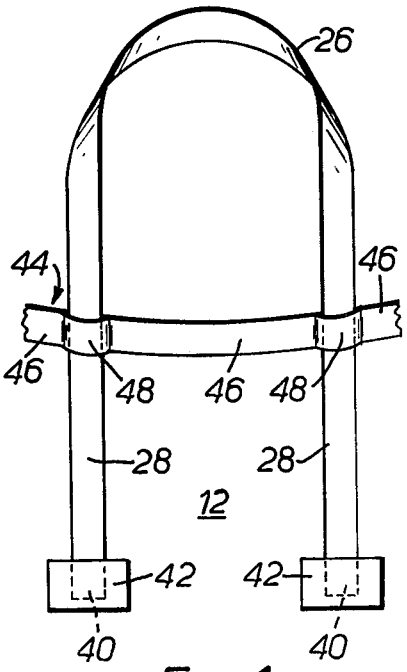

FIG. 4 shows another modification in which the bonded end portions 28 of each lifting web are positioned vertically on the side wall 12 of the bag body. Anti-peel devices 42 similar to those shown in FIG. 3 are employed at the lower ends 40 of each web. At the upper periphery of the side wall 12, two anti-peel devices are provided for each lifting loop 26, as the linear bonded regions 28 of the web are spaced apart in parallel. Each such anti-peel device at the upper periphery of the side wall of the bag body is of similar form to that shown in FIG. 2, but a single strip 44 of plastics coated fabric extending around the entire upper periphery of the side wall is used for forming all said anti-peel devices, said single strip having alternating bonded portions 46 and non-bonded portions 48.

Clearly, various other modifications of the abovedescribed bag are possible within the scope of the invention defined by the appended claims, and the bulk transport bag in accordance with the invention is not restricted to use of the particular fabric materials and plastics coating and impregnating materials referred to. It is essential only that the body fabric and the lifting web fabric should be treated with compatible plastics materials which can be bonded together effectively to combine such fabrics into an integral structure.

In general, at the present time, it is practicable for the base fabric of the bag and/or lifting webs to be made of polyester, polypropylene or polyamide (nylon), or any combination thereof, and the plastics surface treatment to be an impregnation and/or coating of PVC, polyurethane or synthetic rubber (neoprene), or a laminant coating of such materials.

For the purpose of welding such materials together, hot arc welding, hot air welding, ultrasonic welding or pulse welding may be employed instead of the conventional high frequency welding technique which is usually to be preferred. It is required that the bonding technique employed should effectively merge one plastics coating material into the other; the use of plastics adhesive solvents is therefore sometimes practicable. Where neoprene is employed as a coating for the bag fabric, it will generally be necessary also to employ neoprene as the coating on the web fabric, in order to achieve the required bond, in particular by ultra high frequency welding. In other instances, however, it is possible to effect the bond between a PVC coating on the bag fabric and a polyurethane impregnation and/or coating on the lifting web fabric, or vice versa, or between a laminant coating of such materials on one fabric and a single coating or laminant coating of such materials on the other fabric.

I claim:

1. A bulk transport bag comprising a main materials-containing body having a side wall, a top wall with a closable inlet and a bottom wall with a closable outlet for the material to be carried, the body comprising a fabric coated with a plastic material, lifting means attached to said body, the lifting means comprising a plurality of fabric webs coated and/or impregnated with a plastic material compatible with the plastic coating of the body, said plastic treated lifting webs each having, on both sides of a lifting loop, linear end portions through which the weight of the load is transferred to the lifting loops from the body of the bag, said linear end portions being secured to the side wall of the plastic coated body by the bonding together of said compatible plastic materials by a weld, and each of said linear end portions, where it separates from the side wall of the bag to start the lifting loop, being retained close to the body by an anti-peel device of fabric coated with a compatible plastic material which is bonded to the plastic coating of the body whereby said load transfer occurs without detachment of the lifting webs.

2. A bulk transport bag according to claim 1, wherein said inlet and outlet are sealed to the bag body so that the bag is thereby rendered wholly impervious to liquid when the inlet and outlet are closed.

3. A bulk transport bag according to claim 1, wherein the plastics coated and/or impregnated webs constituting the lifting means are each bonded to the side wall of the bag body at an angle to the vertical, with web portions of each web crossing one another in the manner of braces to pass through a common anti-peel device at the periphery of the side wall of the bag.

4. A bulk transport bag according to claim 1, wherein the closable inlet and outlet comprise a central inlet chute opening through a top wall of the bag body and a central outlet spout opening out of a bottom wall of the bag body, all parts of the bag body being made of pieces of the same plastics coated fabric bonded together to define a bag of predetermined shape.

5. A bulk transport bag according to claim 1, wherein the bag body is made of one of nylon and polyester fabric coated with PVC and the lifting webs are made of polyester fabric impregnated and/or coated with PVC.

6. A bulk transport bag according to claim 1, wherein each said plastics treated lifting web is bonded at both sides of an intermediate portion of the length thereof to the side wall of the main body, so that the intermediate portion forms a lifting loop at the top of the main body, the plurality of lifting loops being symmetrically disposed around the periphery of the main body.

7. A bulk transport bag according to claim 6, wherein each lifting web is bonded along two linear regions of the bag body spaced around the side wall thereof.

8. A bulk transport bag according to claim 7, wherein said two linear bonding regions are inclined when the bag is in its upright condition, said two inclined linear bonding regions meeting at the upper periphery of the side wall of the bag.

9. A bulk transport bag according to claim 8, wherein each lifting web is bonded to the bag body over its entire length on each side of the intermediate portion forming the lifting loop, and each end of each bonded lifting web is covered by a bonded patch of plastics coated fabric, thereby to form an anti-peel device.

10. In a bulk transport bag of the type having (i) a body comprised of a plastic coated fabric forming an enclosure for material to be transported, the enclosure having a side wall disposed between top and bottom walls, the body having closable means providing an inlet and an outlet, and (ii) lifting straps attached to the side wall of the body for providing external means to lift the bag, each lifting strap having two elongate segments extending from an intermediate portion, the improvement whereby the lifting straps are attached to the side wall of the body by means comprising (a) plastic bonding material securing the lifting straps to the side wall of the body, the plastic bonding material being adherent to the lifting straps and being bonded by a weld to the plastic material of the coated body at at least the end portions of said lifting straps, and (b) anti-peeling means for preventing tearing of the straps from the body, the anti-peeling means being attached to the body and retaining the straps close to the body adjacent the sites where the straps separate from the body.

11. The improvement according to claim 10, wherein the anti-peeling means is a belt attached to and surrounding the body.

12. The improvement according to claim 11, wherein the belt provides a plurality of apertures disposed about the periphery of the body, and each of said lifting straps extends through a different one of said apertures.

13. The improvement according to claim 10, wherein the two elongate segments are bonded throughout their lengths to the side wall of the body.

14. The improvement according to claim 13, wherein the intermediate portion of the lifting strap forms a loop with the neck of the loop adjacent to the anti-peeling means.

* * * * *